US006052832A

United States Patent [19]

Crompton

[11] Patent Number: 6,052,832

[45] Date of Patent: Apr. 25, 2000

[54] HELMET MOUNTED MIRRORS FOR OFF ROAD USE

[76] Inventor: David Crompton, 4341 Mushroom Rd., Snover, Mich. 48472

[21] Appl. No.: 08/948,164

[22] Filed: Oct. 9, 1997

Related U.S. Application Data

[60] Provisional application No. 60/029,123, Oct. 17, 1996.

[51] Int. Cl.[7] ..... A42B 1/24

[52] U.S. Cl. ..... 2/422; 2/425; 2/909; 2/DIG. 8; 359/880; 248/278.1

[58] Field of Search ..... 2/422, 410, 411, 2/424, 425, 209.13, 909, 918, DIG. 8; 359/876, 879, 880, 872; 351/50; 248/479, 278.1, 485, 486, 487

[56] References Cited

U.S. PATENT DOCUMENTS

| | | | |
|---|---|---|---|
| 574,877 | 1/1897 | Bromiley | 359/880 |
| 812,660 | 2/1906 | Lovegrove | 248/479 |
| 1,041,002 | 10/1912 | Bergh | 248/278.1 |
| 1,628,704 | 5/1927 | Zartman | 359/602 |
| 2,606,479 | 8/1952 | Howe | 359/880 |
| 3,379,403 | 4/1968 | Meehan | 248/278.1 X |
| 4,349,246 | 9/1982 | Binner | 359/880 |
| 4,893,356 | 1/1990 | Waters | 2/422 |
| 5,432,960 | 7/1995 | Kraut | 359/879 X |

FOREIGN PATENT DOCUMENTS

| | | | |
|---|---|---|---|
| 2303493 | 8/1976 | France | 2/422 |

OTHER PUBLICATIONS

Gershman, "Self–Adhering Nylon Tapes", J.A.M.A., p. 930, Oct. 1958.

*Primary Examiner*—Peter Nerbun

[57] ABSTRACT

A mirror assembly is provided that can be affixed to a helmet for use by snowmobile, motorcycle and ATV vehicle riders. The mirrors are capable of adjustment in three directions and are detachable from the helmet.

2 Claims, 4 Drawing Sheets

HELMET MOUNTED MIRRORS FOR OFF ROAD USE

HELMET MOUNTED MIRRORS FOR OFF ROAD USE

BRACKET MECHANISM 18

HELMET MOUNTED MIRRORS FOR OFF ROAD USE

HELMET MOUNTED MIRRORS FOR OFF ROAD USE

HELMET MOUNTED MIRRORS FOR OFF ROAD USE

This application claims benefit of provisional application 60,029,123 filed Oct. 17, 1996.

BACKGROUND OF INVENTION

The present invention relates to a pair of mirrors that can be affixed to a full face helmet commonly used by snowmobile, ATV, and motorcycle riders. These mirrors give a safe and quick rear view for all riders of the above mentioned vehicles.

Conventional apparatus used for rear viewing during operation of off road motor vehicles have many disadvantages. The most common form of rear viewing is the operator turning his or her head around to see what is behind them. This method of rear viewing causes two severe problems. One being the total loss of view in the direction the operator is traveling. The second is the poor control the operator has over the vehicle in this contorted body position.

Another apparatus used for rear viewing on such listed vehicles is permanently mounted mirrors on the vehicle's body. Most vehicle mounted mirrors must be custom mounted using bolts or screws that require drilling holes into the hood or body of the vehicle. This in turn decreases the value of the vehicle. Vehicle mounted mirrors also often altar the vehicles exterior lines to the point that the machine's protective cover will no longer fit. During vehicle operation the engine and the travel of the vehicle over bumpy terrain causes vibrations that blur the view in permanently mounted mirrors. This vibration has also been known to crack or damage the surface the mirror is mounted to.

A third apparatus available for rear viewing on snowmobiles, ATV's, and motorcycles is hand mirrors. Hand mirrors are strapped to the back of the users hand. Hand mirrors are very unsafe to use during vehicle operation. To use hand mirrors, you must raise your hand off the handle bars to see, thus having no control of the brake lever.

The last available apparatus for rear viewing on off road vehicles is a handlebar mounted strap-on mirror. This version of rear viewing causes two problems. One being a blurred vision from the vibration sent through the handle bars. The second problem is the view from this type of mirror is limited to straight behind your vehicle on the one side the mirror is strapped to, thus creating a large blind spot on the entire other side of the vehicle.

SUMMARY OF INVENTION

Accordingly, it is the primary objective of the present invention to provide the safest and quickest rear view possible while operating a snowmobile, ATV, or motorcycle.

It is another objective of the present invention to provide an apparatus that will provide a rear view to the above said operators without permanently altering the operator's helmet or vehicle.

The objectives of the present invention are fulfilled by providing an apparatus that fastens to the operators helmet using a hook and loop fastener with an adhesive backing. Thus creating a bond that may be removed and reinstalled every time the operator stores his or her helmet, or transports their helmet in a protective bag. This apparatus also allows the operator to take advantage of the safest and quickest rear view possible by providing the following: no hand movements required which leaves the operator in control of the vehicle with both hands on the handlebars; a quick blind spot free view on both sides of the operator with no head or body movements needed, only a very slight eye movement similar to the glance needed to look at a speedometer while driving a car. This apparatus is fully adjustable with three rotating axis mounted to each side mirror. This allows them to adjust to all full face helmets with no drilling or bolting.

BRIEF DESCRIPTION OF THE DRAWING

The objective of the present invention and the attendant advantage thereof will become more readily apparent by reference of the following drawings wherein like reference numerals refer to like parts.

DETAILED DESCRIPTION OF PREFERRED EMBODIMENTS

Figure 1:
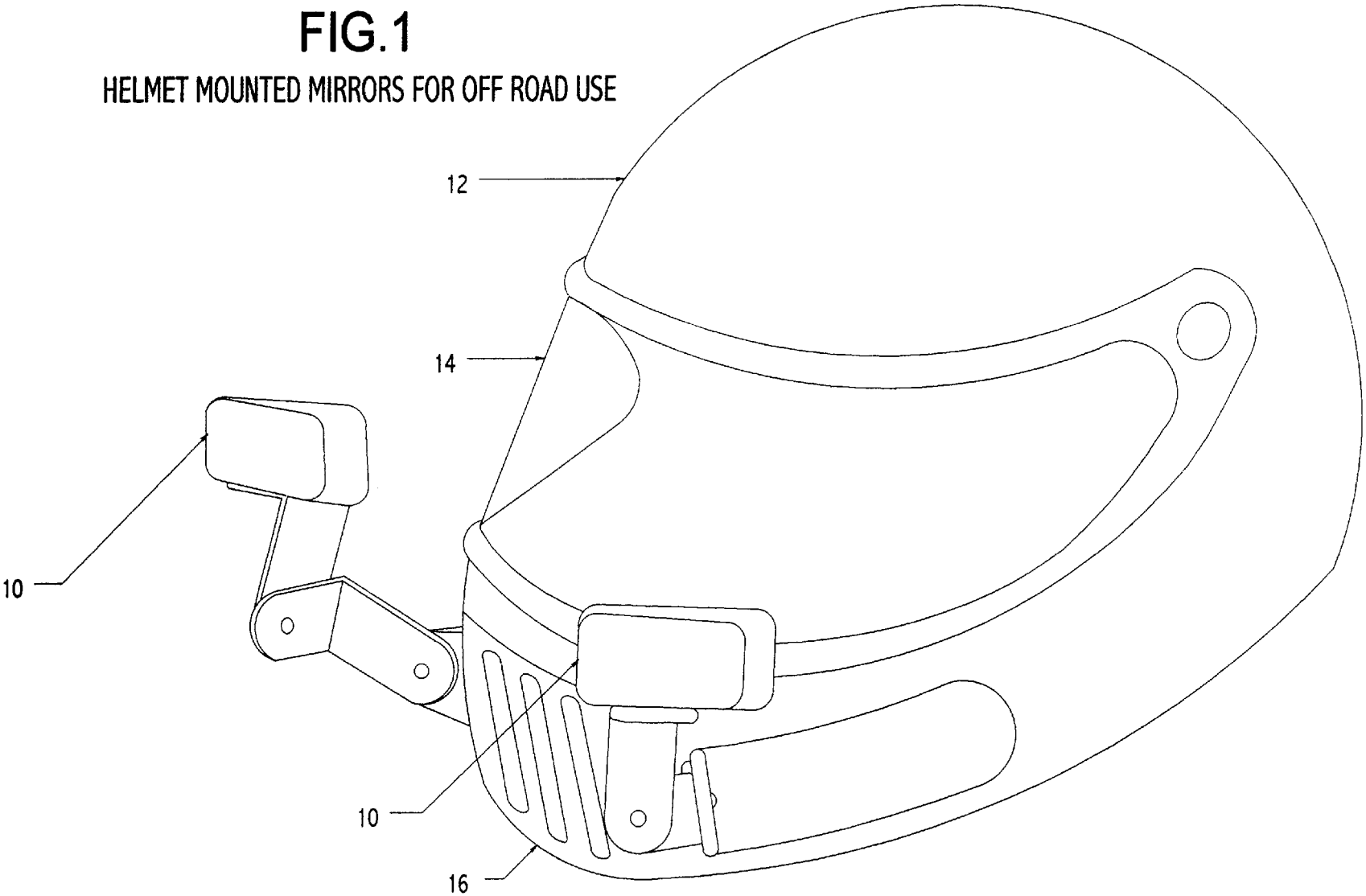
FIG. 1 is a perspective view of a first embodiment of a helmet mounted mirror apparatus according to the present invention.
Figure 2:
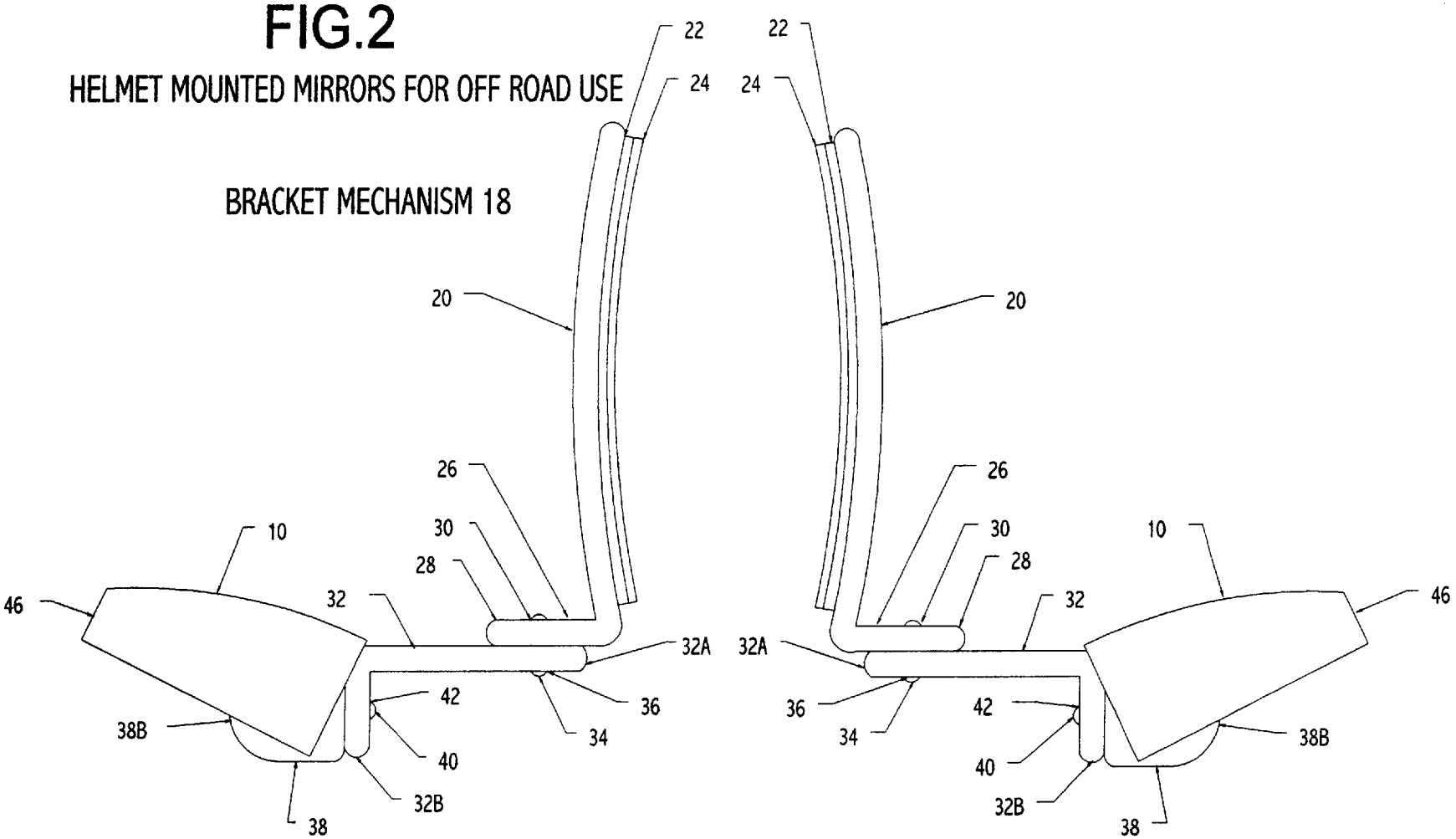
FIG. 2 is a top view of a helmet mounted mirror apparatus to the present invention.
Figure 3:
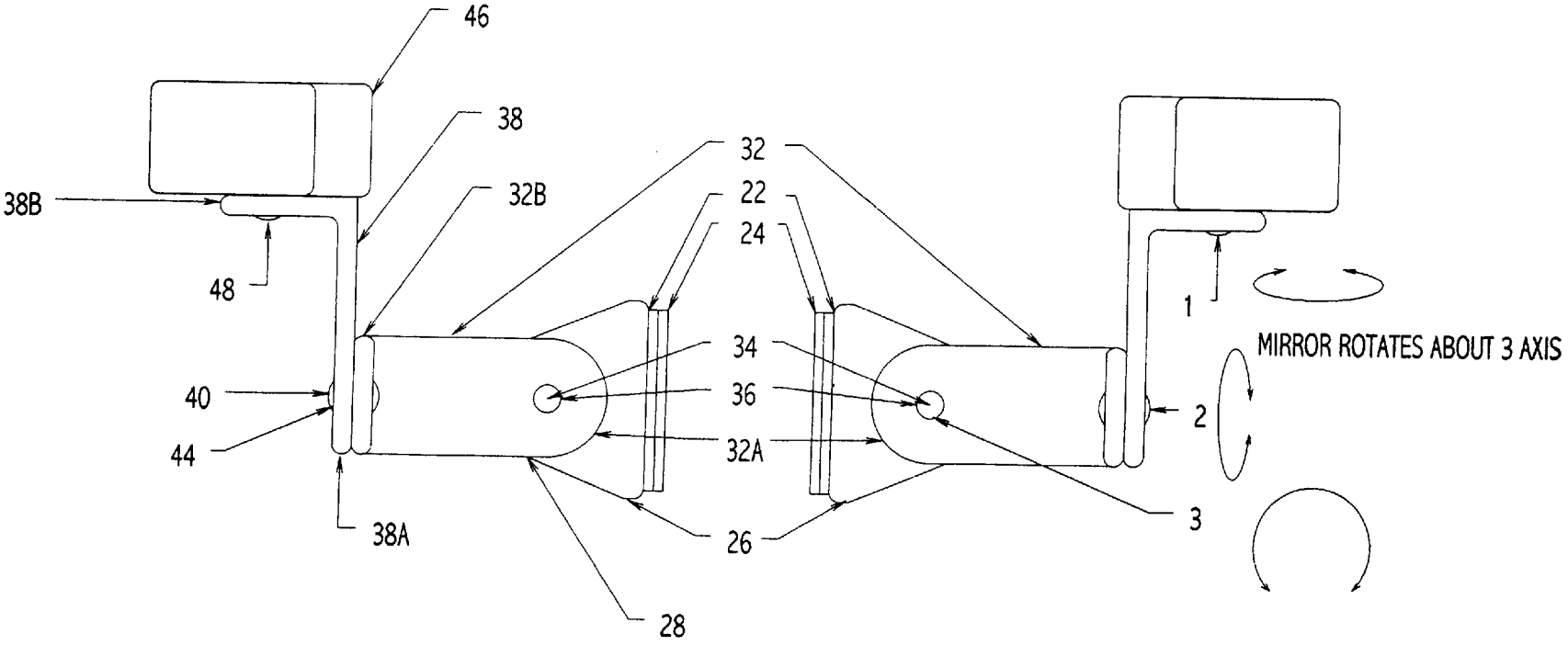
FIG. 3 is a front view of the helmet mounted mirror apparatus shown in FIG. 2.
Figure 4:
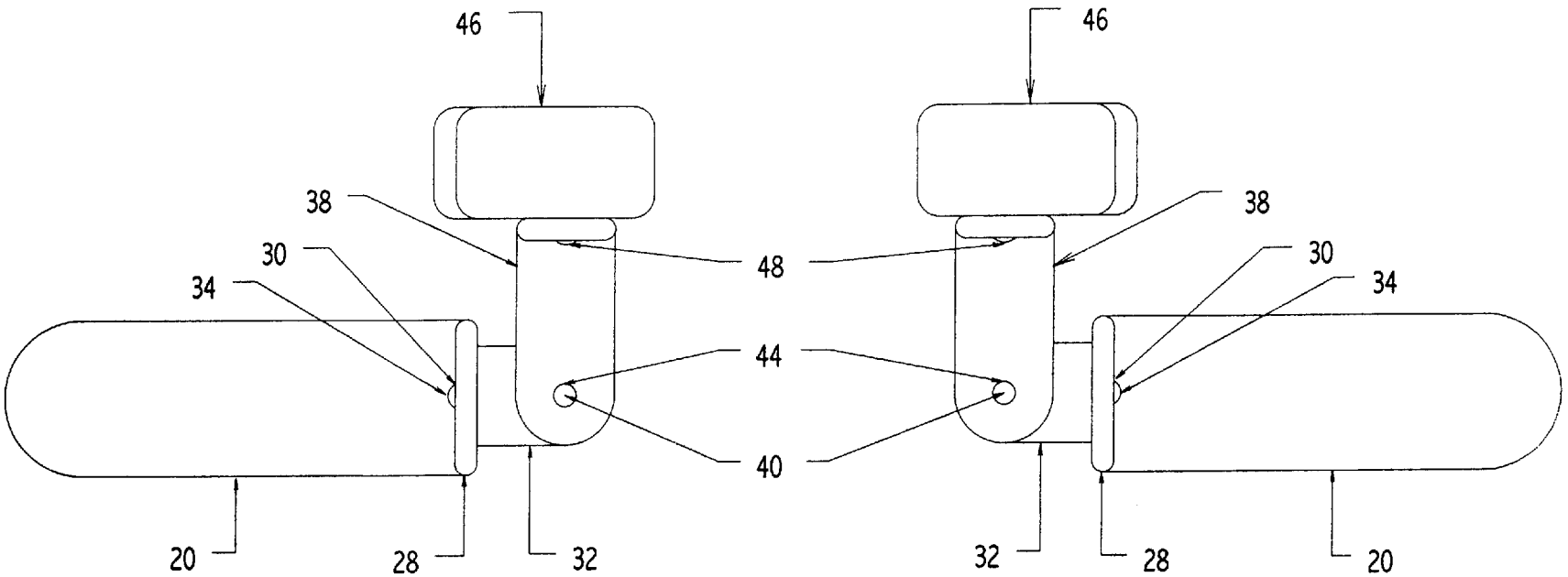
FIG. 4 is a side view of the helmet mounted mirror apparatus shown in FIG. 2.

With reference to the attached drawing, the present invention will be described. FIG. 1 illustrates the mirrors 10 of the present invention mounted to a helmet 12. Helmet 12 includes a face shield 14 pivotally mounted to the helmet 12 and a chin bar portion 16 extending across the face of the helmet.

The mirrors 10 are supported by a bracket mechanism 18. Bracket mechanism 18 includes a contoured plastic bracket member 20 having a hook and loop fastener 22 attached to an inner surface thereof for mating with a corresponding hook and loop member 24 which is preferably applied to chin bar portion 16 by an adhesive backing. The contoured plastic bracket member 20 includes an angled portion 26 and a bracket mounting portion 28 having an opening 30 therein. A first generally L-shaped bracket member 32 is provided with a first end 32*a* pivotally attached to bracket mounting portion 28 by a rivet 34 which extends through an opening 36 in first end 32*a* and through opening 30. First L-shaped bracket 32 is provided with a second end 32*b* generally perpendicular to first end 32*a*. A second generally L-shaped bracket 38 has a first end 38*a* pivotally attached to the second end 32*b* of first bracket 32 by a rivet 40 which extends through an opening 42 in first bracket 32 and through an opening 44 in second bracket 38. Bracket 38 includes a second end 38*b* which is generally perpendicular to first end 38*a*. Second end 38*b* of bracket 38 supports a housing 46 which is attached to the second end 38*b* by a rivet 48. Housing 46 supports a mirror 10 therein. Mirror 10 is preferably a convex mirror which gives a broad viewing range for the vehicle operator.

In operation, the vehicle operator fastens the hook and loop member 24 to the chin bar 16 of the helmet using the adhesive applied to the back of the hook and loop member 24. The hook and loop fastener 22 attached to the contoured plastic bracket member is then engaged with the hook and loop member 24. The position of the mirror can be adjusted along all three axes of rotation. In particular, mirrors 10 can be adjusted in the directions of arrows "A" (generally in a lateral vertical plane) by pivoting first bracket member 32 about rivet 34. Mirrors 10 can be adjusted laterally in the direction of arrows "B" (generally in a fore and aft vertical plane) by pivoting the second bracket 38 about rivet 40 relative to bracket 32. Finally mirrors 10 can be angularly adjusted in the direction of arrows "C" (generally in a horizontal plane) by pivoting housing 46 about rivet 48 relative to second bracket 38. The ability to adjust the mirrors in all three directions allow for convenient adjustment by the operator.

It should be understood by one of ordinary skill in the art that several modifications can be made to the present invention without departing from the spirit and scope of the present invention. It should be apparent that other attachment means may be utilized, including snaps, adhesives, threaded fasteners, rivets, or the base may be integrally formed to the helmet.

I claim:

1. A helmet, comprising:

a rigid shell portion and a cushioned lining disposed inside of said shell portion; and a mirror device including:

a first bracket including a first portion including a hook and loop fastener mounting said first portion of said first bracket to a side of said rigid shell portion and a second portion integrally formed with said first portion and extending generally perpendicular to said first portion;

a second bracket including a first portion pivotally mounted to said second portion of said first bracket, a second portion integrally formed with said first portion of said second bracket and extending generally perpendicular to said first portion of said second bracket;

a third bracket including a first portion pivotally mounted to said second portion of said second bracket, a second portion integrally formed with said first portion of said third bracket and extending generally perpendicular to said first portion of said third bracket; and a mirror pivotally mounted to said second portion of said third bracket, said mirror extending generally perpendicular to said second portion of said third bracket and pivoting about an axis generally parallel to a front surface of said mirror.

2. A mirror device, comprising:

a first bracket including a first portion including a hook and loop fastener adapted to removably mount said first bracket to a side of a helmet and a second portion integrally formed with said first portion and extending generally perpendicular to said first portion;

a second bracket including a first portion pivotally mounted to said second portion of said first bracket, a second portion integrally formed with said first portion of said second bracket and extending generally perpendicular to said first portion of said second bracket;

a third bracket including a first portion pivotally mounted to said second portion of said second bracket, a second portion integrally formed with said first portion of said third bracket and extending generally perpendicular to said first portion of said third bracket; and a mirror pivotally mounted to said second portion of said third bracket, said mirror extending generally perpendicular to said second portion of said third bracket and pivoting about an axis generally parallel to a front surface of said mirror.

* * * * *